US005928094A

United States Patent [19]

Sagedahl

[11] Patent Number: 5,928,094

[45] Date of Patent: Jul. 27, 1999

[54] BASKETBALL PRACTICE DEVICE AND METHOD OF USING SAME

[76] Inventor: Sherwood K. Sagedahl, 459 Water St., Fairmont, Minn. 56031

[21] Appl. No.: 09/074,535

[22] Filed: May 7, 1998

[51] Int. Cl.[6] ..... A63B 69/00

[52] U.S. Cl. ..... 473/447

[58] Field of Search ..... 473/447, 448

[56] References Cited

U.S. PATENT DOCUMENTS

D. 325,947 5/1992 Cass .
D. 368,942 4/1996 Mahoney .
2,918,283 12/1959 Marschalk .
3,160,414 12/1964 Gray .
4,206,915 6/1980 Woodcock .
4,244,569 1/1981 Wong .
4,915,381 4/1990 Hackett .
5,354,048 10/1994 Winesberry, Jr. .
5,603,495 2/1997 Noveck .

*Primary Examiner*—William H. Grieb
*Attorney, Agent, or Firm*—Zarley, McKee, Thomte, Voorhees & Seas

[57] ABSTRACT

A clip having a contrasting color to a basketball rim is mounted on the topside of the rim on a line between the shooter and the center of the basket for the shooter to focus on while aiming and shooting the ball over the clip. The clip is moveable around the circumference of the rim for practice shooting from any location on the basketball court.

6 Claims, 2 Drawing Sheets

BASKETBALL PRACTICE DEVICE AND METHOD OF USING SAME

BACKGROUND OF THE INVENTION

Successful shooting in playing basketball involves training the shooter to focus only on the basket and shutting out all the distractions that surround the shooter.

Heretofore, there have been numerous practice devices that have improved shooting as their goal. Representative prior art patents include Gray U.S. Pat. No. 3,160,414 and Woodcock U.S. Pat. No. 4,206,915. Many of these devices are complicated, expensive and less effective than desired.

What is needed is a device for focusing the shooter's attention that can be quickly attached to the basketball rim, moved to any position on the rim as desired and easily removed when practice has been completed.

SUMMARY OF THE INVENTION

A U-shaped clip made of plastic in a color contrasting to the basketball rim is attached to the topside of the rim and frictionally held until removed by a screwdriver or the like inserted between the clip and the rim, whereby the clip is pried up and off the rim.

The clip has a length of seven inches when measured on a straight line between its opposite ends. This length is less than one-fourth of the basketball rim's circumference in order to make it a target for the shooter to focus on. The length of the clip should not be too long such that it becomes the rim and not too short such that it is not big enough for the shooter to easily see and target while shooting.

DESCRIPTION OF THE PREFERRED EMBODIMENT

Figure 1:
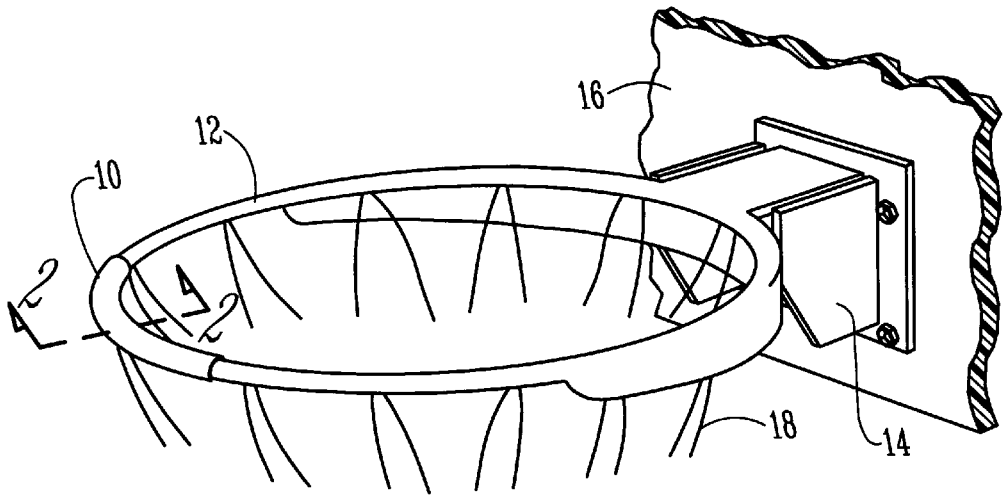
FIG. 1 is a fragmentary perspective view of a basketball rim having the basketball practice device of this invention mounted thereon on the forward edge of the rim.

The clip of this invention is referred to generally in FIG. 1 by the reference numeral 10 and is shown mounted on a basketball rim 12 secured by a bracket 14 to a backboard 16. A net 18 is attached to the rim in a conventional manner.

Figure 2:
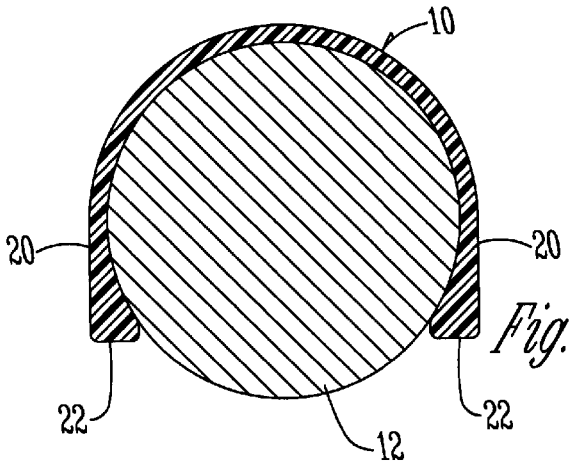
FIG. 2 is a cross-sectional view taken along line 2—2 in FIG. 1.

A typical rim 12 is ⅝ inch in cross-sectional diameter and the clip 10 is U-shaped and includes a pair of legs 20 which are normally spaced apart slightly less than the diameter of the rim 12 such that when they are pressed over the rim 12 they will frictionally hold the clip 10 tightly to the rim. The legs 20 have outer free edges 22 which are thickened to further enhance the gripping action around the rim 12. It is seen in FIG. 2 that the cross-sectional length of the clip is less than the circumferential length of the rim in cross-section but more than 180 degrees. The thickness of the clip 10 throughout its substantial length is preferably 1/16 of an inch while the outer free edges 20 are approximately ⅛ inch in thickness.

Figure 3:
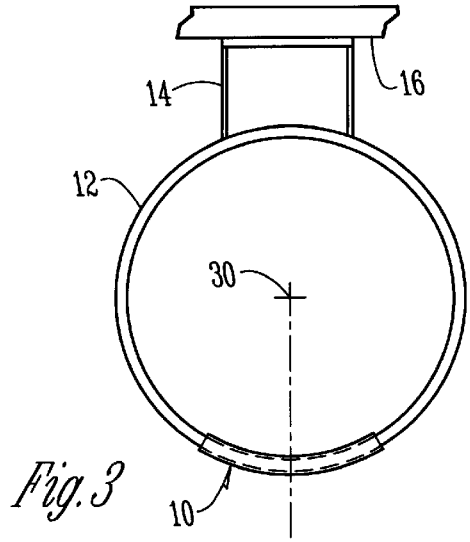
FIG. 3 is a diagrammatic top plan view of the basketball rim having the clip mounted thereon being the target of the shooter with the ball being shot from a straight on position on the basketball court.

As seen in FIG. 3 the clip 10 is positioned such that it is centered on a line between the center 30 of the rim 12 and the shooter represented by the ball 32. In this view the shooter is standing in front of the basket as in shooting free throws.

Figure 4:
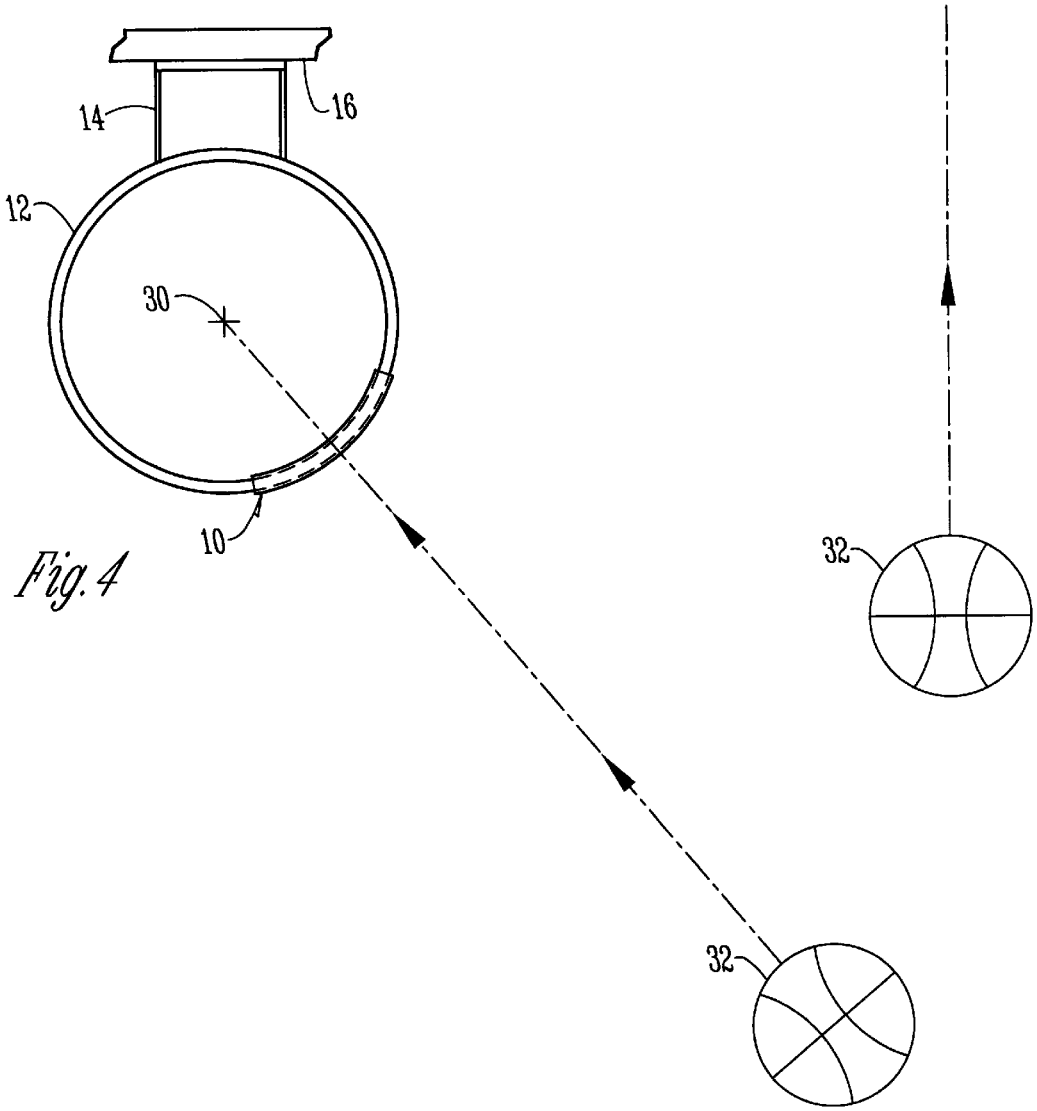
FIG. 4 is view similar to FIG. 3 but showing the clip moved to another position on the rim while remaining on a straight line extending between the center of the basket and the shooter.

In FIG. 4 the clip 10 has been moved at an angle but is still centered on a line between the center 30 of the rim 12 and the shooter with the ball 32. In all cases, the shooter focuses on the clip while aiming and shooting just over the clip for the ball to land at the center 30 of the rim 12. It is believed that through the use of the basketball device of this invention the shooter will be able to shut out environmental distractions, relax and perform at a higher level of shooting accuracy.

While the clip 10 will have an appearance contrasting to the rim 12, a preferred color is fluorescent orange which will contrast to the conventional orange rim. When it is desired to remove the clip 10 from the rim it is easily accomplished through the use of a screwdriver positioned between the inside of the clip 10 and the adjacent edge of the rim. A prying action will cause the clip to pop off the rim.

What is claimed is:

1. A basketball practice device adapted to be attached to a basketball rim comprising;

a U-shaped clip being curved along its length for matingly clamping onto a basketball rim;

said U-shaped clip in length being less than ¼ the circumferential length of the rim to which it is to be attached;

said U-shaped clip having an appearance contrasting with the appearance of the basketball rim, for creating a point of focus for their shooter; and said clip being adapted to be movably positioned on said rim to be on line with a person shooting, and at a location closest to the person shooting, to provide a focusing point on the forward edge of the rim.

2. The basketball practice device of claim 1 wherein said clip is made of plastic material.

3. The basketball practice device of claim 2 wherein said U-shaped clip includes a pair of oppositely disposed legs spaced apart less than the diameter of the rim and having memory for clamping said legs around the rim when spread apart to embrace the rim.

4. The basketball practice device of claim 1 wherein the contrasting appearance of said U-shaped clip includes the color of the U-shaped clip being different from the color of the basketball rim to contrast therewith.

5. A basketball practice device adapted to be attached to a basketball rim comprising, a U-shaped plastic clip being curved along its length for matingly clamping onto a basketball rim, said U-shaped clip having an appearance contrasting with the appearance of the basketball rim for creating a point of focus for the shooter, said U-shaped clip including a pair of oppositely disposed legs spaced apart less than the diameter of the rim and having memory for clamping said legs around the rim when spread apart to embrace the rim, and said U-shaped clip oppositely disposed legs having outer free edges which are thickened relative to said U-shaped clip throughout its cross-sectional width.

6. A method of improving basketball shooting accuracy comprising the steps of, providing a basketball rim, providing a clip having an appearance contrasting with the appearance of the basketball rim and being in length less than ¼ the circumferential length of the rim, positioning the clip on the basketball rim on line with the person shooting and at a location closest to the person shooting, and focusing on the clip on the forward edge of the rim while aiming and shooting the basketball over the clip into the basket.

* * * * *